US008905522B2

(12) United States Patent
Koyata et al.

(10) Patent No.: US 8,905,522 B2
(45) Date of Patent: Dec. 9, 2014

(54) INK-JET HEAD AND METHOD OF MANUFACTURING INK-JET HEAD

(71) Applicant: Toshiba Tec Kabushiki Kaisha, Shinagawa-ku, Tokyo (JP)

(72) Inventors: Minoru Koyata, Shizuoka-ken (JP); Tomoki Hoshino, Shizuoka-ken (JP); Naoki Ooishi, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/764,891

(22) Filed: Feb. 12, 2013

(65) Prior Publication Data

US 2013/0250005 A1 Sep. 26, 2013

(30) Foreign Application Priority Data

Mar. 22, 2012 (JP) ..... 2012-066330

(51) Int. Cl.

*B41J 2/045* (2006.01)
*B41J 2/14* (2006.01)
*B41J 2/16* (2006.01)

(52) U.S. Cl.

CPC ..... *B41J 2/045* (2013.01); *B41J 2/14209* (2013.01); *B41J 2/1642* (2013.01); *B41J 2/1643* (2013.01); *B41J 2/1609* (2013.01); *B41J 2/1623* (2013.01)

USPC ..... 347/68; 347/69

(58) Field of Classification Search

USPC ..... 347/68, 69

See application file for complete search history.

(56) References Cited

U.S. PATENT DOCUMENTS

| | | | | |
|---|---|---|---|---|
| 5,243,363 | A * | 9/1993 | Koizumi et al. | 347/50 |
| 6,582,057 | B2 * | 6/2003 | Suzuki | 347/44 |
| 2006/0092239 | A1 | 5/2006 | Sung et al. | |
| 2012/0044301 | A1 * | 2/2012 | Yamamoto | 347/68 |
| 2012/0098897 | A1 | 4/2012 | Suzuki | |

FOREIGN PATENT DOCUMENTS

| | | |
|---|---|---|
| JP | 06-143570 | 5/1994 |
| JP | 06-238897 | 8/1994 |
| JP | 10-278259 | 10/1998 |
| JP | 2000-168082 | 6/2000 |

(Continued)

OTHER PUBLICATIONS

Article: Physics: Is statinless steel hydrophilic or hydrophobic?, May 11, 2013.*

(Continued)

*Primary Examiner* — Lisa M Solomon

(74) *Attorney, Agent, or Firm* — Amin, Turocy & Watson, LLP

(57) ABSTRACT

According to one embodiment, an ink-jet head includes an insulated substrate, a plurality of piezoelectric elements which are formed on the insulated substrate in the form of a line, a pressure chamber formed between the two adjacent piezoelectric elements to which ink is supplied, an electrode formed on a surface of the piezoelectric element and a surface of the insulated substrate, an organic protection film to cover a face of the electrode contacting the ink, a hydrophilic film which is formed to cover the organic protection film at a temperature of not more than 100° C., a frame which is provided on the electrode on the insulated substrate to surround the line of the piezoelectric elements, and a nozzle plate provided on the frame having nozzles each opening into the pressure chamber.

5 Claims, 3 Drawing Sheets

(56) References Cited

FOREIGN PATENT DOCUMENTS

| | | |
|---|---|---|
| JP | 2010-188715 | 9/2010 |
| JP | 2010-214895 | 9/2010 |
| JP | 2012-035606 | 2/2012 |

OTHER PUBLICATIONS

Wikipedia Article: Polyurea, Section: Polymer Structure.*
Article: Polyimide Plastic, Paragraph 1.*
Wikipedia Article: Polyurea, Section: Polymer Structure, Feb. 26, 2014.*
Article: Polyimide Plastic, Paragraph 1, Mar. 29, 2014.*
Office Action of Notice of Reasons for Refusal for Japanese Patent Application No. 2012-066330 Dated Mar. 18, 2014, 9 pgs.
Office Action of Decision of Rejection for Japanese Patent Application No. 2012-066330 Dated Jun. 11, 2014, 9 pgs.

* cited by examiner

INK-JET HEAD AND METHOD OF MANUFACTURING INK-JET HEAD

CROSS-REFERENCE TO RELATED APPLICATION

This application is based upon and claims the benefit of priority from the prior Japanese Patent Application No. 2012-066330, filed on Mar. 22, 2012, the entire contents of which are incorporated herein by reference.

FIELD

Exemplary embodiments described herein relate to an ink-jet head and a method of manufacturing an ink-jet head.

BACKGROUND

An ink-jet head of an ink-jet printer is provided with an insulated substrate on which pressure chambers are provided and a nozzle plate in which nozzles are provided. Ink is supplied to the pressure chamber, and the nozzle discharges an ink droplet. The pressure chambers are formed by providing a plurality of grooves on a piezoelectric element member on the insulated substrate, and each has an electrode at a side surface and a bottom surface thereof. When a voltage is applied to the electrode, the piezoelectric element deforms and thereby the volume of the pressure chamber varies. The pressure chamber is reduced to cause the ink inside the pressure chamber to be pressurized, and thereby the ink is discharged from the nozzle as an ink droplet.

In order to prevent that a current flows from the electrode to ink, an organic protection film is usually formed on the surface of the electrode contacting ink. Though having high electrical insulation properties, the organic protection film also has high water-shedding property and is easy to shed water. In order to prevent air bubbles from being involved in the ink, it has been proposed that a hydrophilization treatment such as a UV treatment and a plasma treatment is preformed on the organic protection film to thereby improve the hydrophilic property thereof. When an inorganic film with high hydrophilic property is formed on the organic protection film, the hydrophilic property of the surface contacting ink can be improved, and a sputtering method or a PE-CVD (Plasma-Enhanced Chemical Vapor Deposition) method is used for forming an inorganic film.

In addition, it has been proposed that at the time of forming a hydrophobic insulating film having water-shedding property opposite of hydrophilic property on an electrode, an atomic layer deposition (Atomic Layer Deposition: ALD) method is used.

The effect of hydrophilization by a plasma treatment which is performed on an organic protection film goes down as time passes, and may dissolve in several weeks. In a manufacturing process of an ink-jet head, heating and ultrasonic cleaning are sometimes performed after a plasma treatment. In this case, the effect by the plasma treatment is reduced to thereby cause the air bubbles to be involved when water-based ink is used.

With a film forming method such as a sputtering method and a PE-CVD method, it is difficult to form an inorganic film with a uniform thickness in a whole fine pressure chamber. The film is formed thick at the upper position in the pressure chamber, but it is difficult to form the film at the lower portion, and thereby the hydrophilic properties become different by location. In addition, at the time of forming an inorganic film with such a method, the temperature within a film forming tank becomes to a high temperature of not less than 150° C.

The organic protection film is damaged with such a high temperature, and thereby the effect to protect the electrode from the ink drops.

DETAILED DESCRIPTION

In general, according to one embodiment, there is provided an ink-jet head including: an insulated substrate; a plurality of piezoelectric elements which are formed on the insulated substrate in the form of a line; a pressure chamber formed between the two adjacent piezoelectric elements to which ink is supplied; an electrode formed on a surface of the piezoelectric element and a surface of the insulated substrate; an organic protection film to cover a face of the electrode contacting the ink; a hydrophilic film which is formed to cover the organic protection film at a temperature of not more than 100° C.; a frame which is provided on the electrode on the insulated substrate to surround the line of the piezoelectric elements; and a nozzle plate provided on the frame having nozzles each opening into the pressure chamber.

Hereinafter, embodiments will be specifically described with reference to the drawings.

Figure 1:
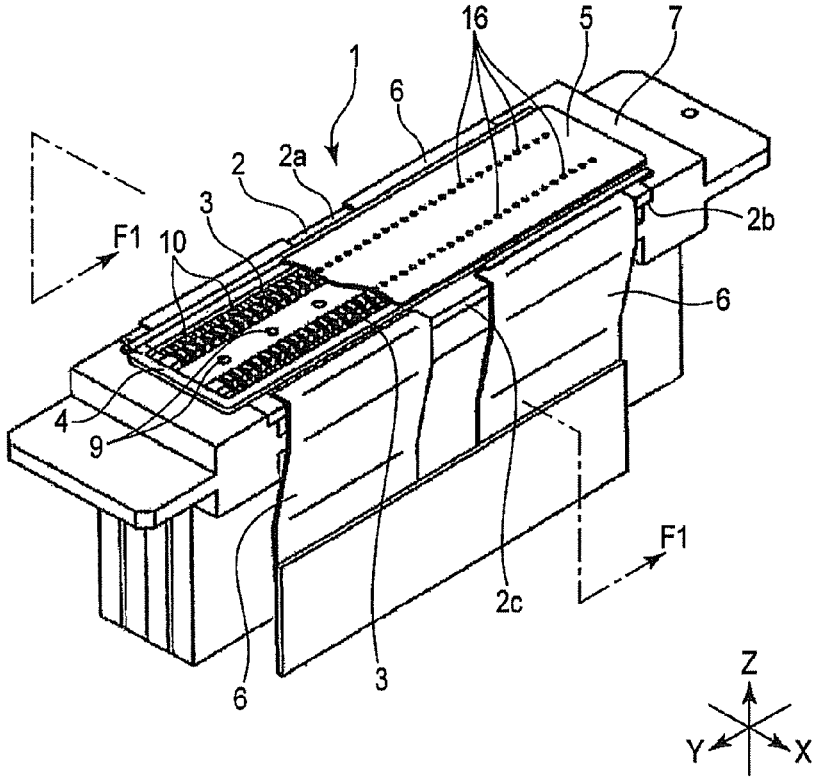
FIG. 1 is a partially cutaway perspective view of an ink-jet head.
Figure 2:
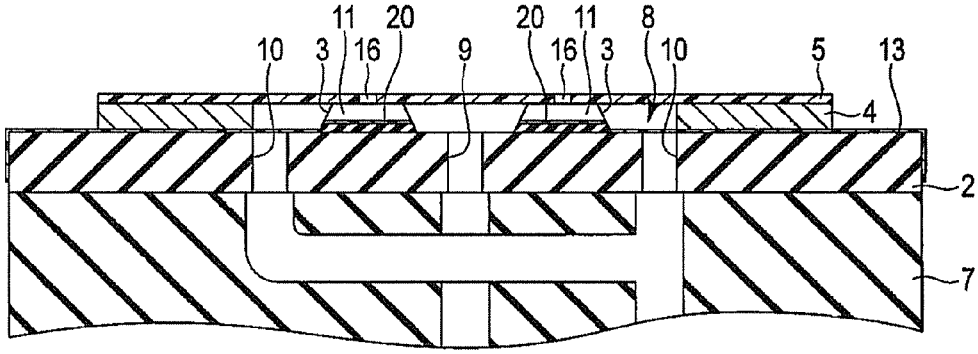
FIG. 2 is a sectional view of the ink-jet head taken along an F1-F1 line in FIG. 1.

FIG. 1 is a partially cutaway perspective view schematically showing a configuration of an ink-jet head 1 in an embodiment. A sectional view taken along F1-F1 in FIG. 1 is shown in FIG. 2.

The ink-jet head 1 has a manifold 7, an insulated substrate 2, a nozzle plate 5, and a drive IC 6. The ink-jet printer head 1 has an approximately rectangular solid shape having a first direction X and a second direction Y which is longitudinal and approximately orthogonal to this direction. The direction orthogonal to an X-Y plane is a third direction Z, and an ink droplet is discharged in the third direction Z. Accordingly, this ink-jet head 1 is of a so-called side shooter type.

A line of piezoelectric elements 3 surrounded by a frame 4 is arranged on the insulated substrate 2.

The insulated substrate 2 is a substrate made of ceramics such as alumina, or made of glass, for example, and is of an approximately rectangular plate shape with the longitudinal portion in the second direction Y. The insulated substrate 2 has an upper surface 2*a* at the side facing the nozzle plate 5, and a lower surface 2*b* at the side facing the manifold 7. The insulated substrate 2 like this has ink supply ports 9 and ink discharge spouts 10. The ink supply ports 9 and the ink discharge spouts 10 penetrate through the insulated substrate 2 from the upper surface 2*a* to the lower surface 2*b*.

The frame 4 is of a metal rectangular frame shape, for example. The frame 4 is arranged on the upper surface 2*a* of the insulated substrate 2. On the upper surface 2*a* of the insulated substrate 2, at the inside portion surrounded by the frame 4, a line of piezoelectric elements 3 is arranged. Each of the piezoelectric elements 3 lines up along the second direction Y, and the space between the adjacent piezoelectric elements 3 becomes a pressure chamber. Accordingly, a plurality of pressure chambers line up along the second direction Y.

The piezoelectric elements 3 are made of PZT (lead zirconate titanate), for example, and are formed by gluing two piezoelectric plates made of PZT together such that their directions of polarization become opposite to each other. The piezoelectric element 3 has a trapezoidal cross section in the X-Z plane and a rectangular cross section in the Y-Z plane.

In the example shown in FIG. 1, two lines of the piezoelectric elements 3 which line up along the second direction Y are formed. A plurality of the ink supply ports 9 line up at the approximate central portion of the insulated substrate 2, that is, between the two lines of the piezoelectric elements along the second direction Y. A plurality of the ink discharge spouts 10 line up at the peripheral portion of the insulated substrate 2, that is, between the piezoelectric elements and the frame 4 along the second direction Y. Each of the pressure chambers is sandwiched by the ink supply port 9 and the ink discharge spout 10, and with the configuration like this, ink is supplied from each of the ink supply ports 9 toward the pressure chamber, and ink which has passed through the pressure chamber is discharged from each of the ink discharge spouts 10.

The nozzle plate 5 is made of resin such as polyimide, or made of metal having heat resistance such as nickel alloy and stainless-steel, for example, and is of an approximately rectangular plate shape with the longitudinal portion in the second direction Y. The nozzle plate 5 is arranged on the insulated substrate 2 through the frame 4. The nozzle plate 5 is bonded to the frame 4 and the piezoelectric elements 3 with adhesive agent not shown.

The nozzle plate 5 like this has a plurality of nozzles 16. Each of the nozzles 16 is formed to face corresponding one of the pressure chambers separated by the piezoelectric elements 3, and communicates with corresponding one of the pressure chambers. The plurality of nozzles 16 form a nozzle line which line up approximately along the second direction Y. In the example shown in the drawing, two nozzle lines are formed in the nozzle plate 5, but the configuration is not limited to this. The nozzle line may be a line or may be not less than three lines. In addition, though there may be a case where the nozzles 16 adjacent to each other are not exactly on the same straight line along the second direction Y, here, the detailed description thereof will be omitted.

The manifold 7 is bonded to the lower surface 2 of the insulated substrate 2 with adhesive agent not shown. As the adhesive agent to bond the manifold 7 and the insulated substrate 2, the adhesive agent to bond the insulated substrate 2 and the frame 4, and the adhesive agent to bond the nozzle plate 7, and the frame 4 and the piezoelectric elements 3, thermosetting resin with ink resistance characteristics can be used. Specifically, epoxy adhesive, silicone adhesive, and acrylic adhesive and so on can be quoted.

As shown in the sectional view of FIG. 2, in the region surrounded by the insulated substrate 2, the frame 4 and the nozzle plate 5, a common ink chamber 8 to which ink is supplied exists. A derivatized electrode 20 is provided on the surface of the piezoelectric element 3 and the surface of the insulated substrate 2, and a wiring pattern 13 is provided on the insulated substrate 2 from the upper surface 2*a* to a side surface 2*c*.

The ink supply port 9 opens into the common ink chamber 8, and the ink discharge spout 10 also opens into the common ink chamber 8. The ink supply port 9 and the ink discharge spout 10 are interlinked to an ink tank (not shown) through the manifold 7. The ink in the ink tank is supplied to the common ink chamber 8 from the ink supply port 9, and the ink within the common ink chamber 8 is recovered from the ink discharge spout 10 to the ink tank.

Figure 3:
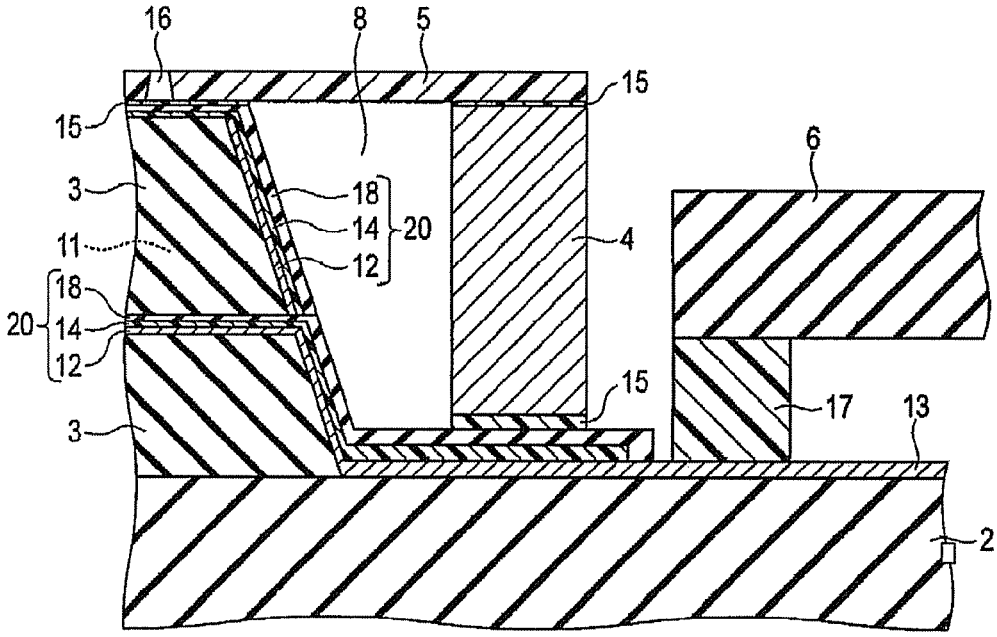
FIG. 3 is an enlarged view of the derivatized electrode in FIG. 2.

As shown in the enlarged view of FIG. 3, the derivatized electrode 20 is provided on the surfaces of the insulated substrate 2 and the piezoelectric element 3 at the region contacting ink. Specifically, the derivatized electrode 20 is provided on the surface of the insulated substrate 2 in the common ink chamber 8, the side surface of the piezoelectric element 3, and the bottom surface of the pressure chamber 11. The derivatized electrode 20 is composed of a laminated film in which an electrode 12, an organic protection film 14, and a hydrophilic film 18 are formed in series. Since the electrodes 12 formed in the common ink chamber 8 and the pressure chamber 11 are coated with the organic protection film 14 and the hydrophilic film 18, the electrodes 12 are kept from contacting ink. Even if the organic protection film 14 and the hydrophilic film 18 extend outside the frame 4 and cover a portion of the wiring pattern 13 as shown in FIG. 3, there will particularly be no problem.

Figure 5:
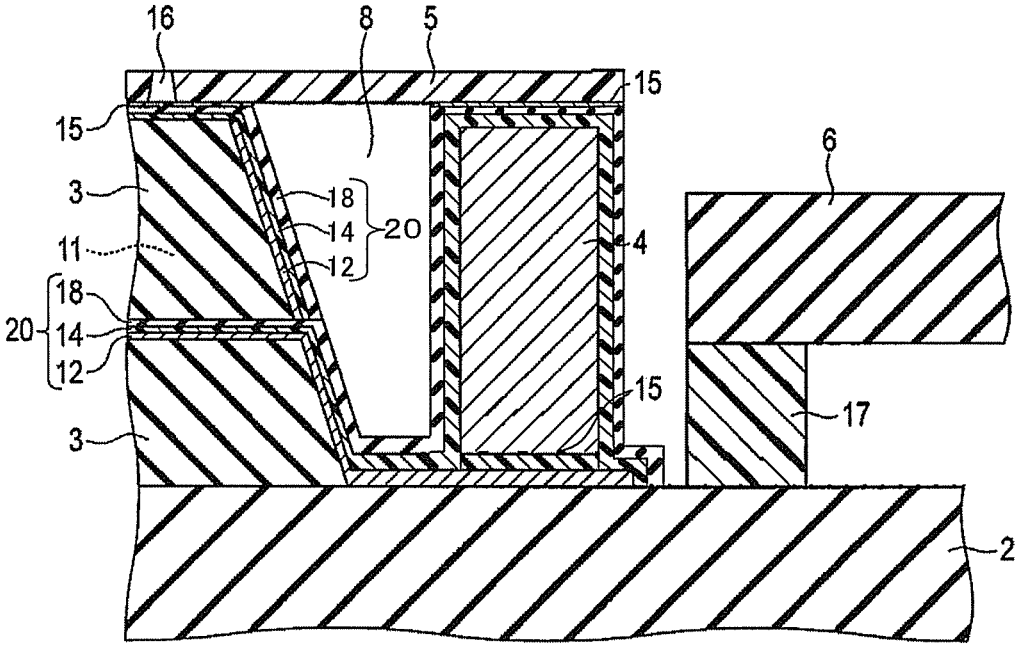
FIG. 5 is an enlarged view of a derivatized electrode of an ink-jet head.

In the embodiment shown in the drawings, though the frame 4 is bonded to the hydrophilic film 18 on the insulated substrate 2 with a bonding layer 15, and the nozzle plate 5 is bonded to the hydrophilic film 18 on the upper surface of the piezoelectric element 3, and the frame 4 with the bonding layer 15, the configuration is not limit to this. Since it is only necessary to prevent the electrode 12 from contacting ink, the organic protection film 14 and the hydrophilic film 18 may be formed on the frame 4, as shown in FIG. 5. In this case, the frame 4 is bonded to the electrode 12 on the insulated substrate 2 with the bonding layer 15, and the nozzle plate 5 is bonded to the hydrophilic film 18 on the upper surface of the piezoelectric element 3 and the hydrophilic film 18 on the upper surface of the frame 4 with the bonding layer 15.

A metal thin film is formed on the piezoelectric element where the pressure chamber is provided, and on the insulated substrate by performing electroless plating, and the electrode 12 can be formed by pattering the metal thin film thus formed. As the metal thin film, a nickel thin film, a metal film, or a cupper thin film can be quoted, for example, and the thickness thereof can be made 0.5-5 μm. A part of the electrode 12 on the insulated substrate 2 acts as the wiring pattern 13.

The drive IC 6 is connected to a plurality of the wiring patterns 13. In addition, FIG. 3 shows a cross section at the region where the drive IC 6 shown in FIG. 1 exists and the ink discharge spout 10 does not exist. A flexible printed circuit board is used as the drive IC 6, which controls the ink-jet head 1 by driving the piezoelectric elements 3. The drive IC 6 is connected to the wiring pattern 13 by a connection 17 as shown in FIG. 3. When an ACF (Anisotropic conductive film) is used as the connection 17, the drive IC 6 is connected to the wiring pattern 13 by thermal compression. For example, other means such as ACP (Anisotropic conductive paste), an NCF (Non conductive film), or NCP (Non conductive paste) can be used as the connection 17.

The drive IC 6 applies a voltage to the electrode 12 through the wiring pattern 13, based on a signal inputted from a controller of an ink-jet printer. The piezoelectric element 3 to which the voltage is applied through the electrode 12 deforms in shear mode, and thereby pressurizes the ink supplied in the pressure chamber 11. The pressurized ink is discharged from the nozzle 16.

The organic protection film 14 is provided on the electrode 12 so as to prevent the electrode 12 from contacting ink. After the electrode on the upper surface of the piezoelectric element 3 is removed in the usual manner, the organic protection film 14 is formed on the remaining electrode 12 with a chemical vapor deposition method and so on with a thickness of 3-10

μm, for example. If the frame 4 is bonded to the electrode 12 on the insulated substrate 2 by the bonding layer 15 before the organic protection film 14 is formed, the organic protection film 14 can be formed on the frame 4.

Organic material having insulation properties and ink resistance can be used for forming the organic protection film 14, and paraxylylene polymer is quoted, for example. Specifically, such organic paraxylylene polymers are so-called parylene C (polychloroparaxylylene), parylene N (polyparaxylylene), and parylene D (polydichloroparaxylylene). In addition, the organic protection film 14 may be formed using other materials such as polyimide.

The hydrophilic film 18 on the organic protection film 14 is formed at a low temperature of not more than 100° C., and may be made of a $TiO_2$ film, an $Al_2O_3$ film, or a $HfO_2$ film. The hydrophilic film like this can be formed with an atomic layer deposition method, for example.

Figure 4:
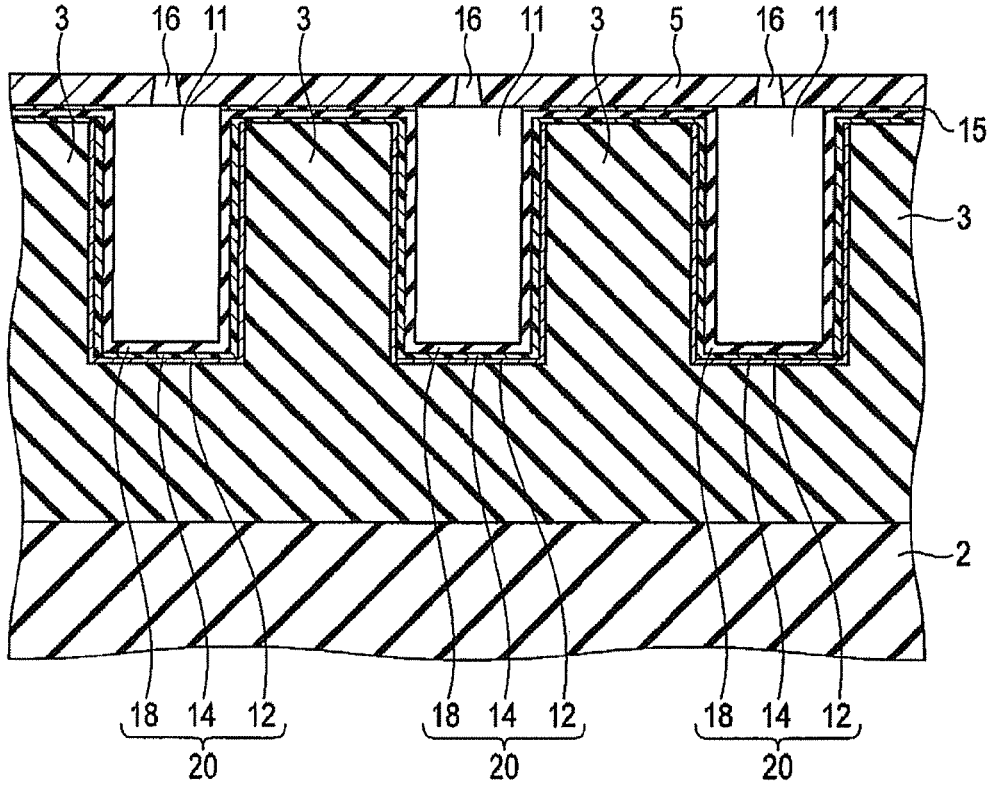
FIG. 4 is a sectional view showing a portion in the direction orthogonal to the plane of paper in FIG. 3.

In the direction orthogonal to the plane of paper, as shown in FIG. 4, a plurality of the pressure chambers 11 each separated by the piezoelectric elements 3 exist, and each of the pressure chambers 11 has the derivatized electrode 20 at the side surface and the bottom surface thereof. As described previously, the derivatized electrode 20 is composed of the electrode 12, the organic protection film 14 and the hydrophilic film 18 which are laminated in series.

Usually, the pressure chamber 11 has a depth of about 300 μm, and a width of about 80 μm. With the adoption of an ALD method, it has become possible to uniformly form the hydrophilic film such as a $TiO_2$ film, an $Al_2O_3$ film, and a $HfO_2$ film on all of the side surface and the bottom surface of the fine pressure chamber like this. The hydrophilic film with a thickness of about 0.005-0.05 μm can be formed with an ALD method. The film thickness of the obtained hydrophilic film is excellent in uniformity, and the variation in the film thickness is as small as not more than 10%. The hydrophilic film is also formed on the side surface of the piezoelectric element 3 and on the surface of the insulated substrate 2 with the approximately same thickness as in the case of the side surface and the bottom surface of the pressure chamber 11. Accordingly, in the common ink chamber and the pressure chamber, the hydrophilic properties of the faces contacting ink are not different by location.

In addition, since the hydrophilic film can be formed at a low temperature of not more than 100° C. with an ALD method, the organic protection film is never damaged. Since the insulation properties of the organic protection film are kept, the electrode can be surely protected from ink. The hydrophilic film formed with an ALD method is not damaged, even if it is subject to ultrasonic treatment and heating treatment in the later process, and thereby the intended hydrophilic property is not impaired. Accordingly, even if water type ink is used, it becomes possible to fill the pressure chamber with the ink without involving air bubble.

While certain embodiments have been described, these embodiments have been presented by way of example only, and are not intended to limit the scope of the inventions. Indeed, the embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method of manufacturing an ink-jet head comprising:

forming a plurality of piezoelectric elements on an insulated substrate in the form of a line;

forming a pressure chamber between the two adjacent piezoelectric elements to which ink is supplied;

forming an electrode on a surface of the piezoelectric element and a surface of the insulated substrate;

forming an organic protection film to cover a face of the electrode contacting the ink;

forming a hydrophilic film to cover the organic protection film at a temperature of not more than 100° C.;

providing a frame on the electrode on the insulated substrate to surround the line of the piezoelectric elements; and providing a nozzle plate having nozzles each opening into the pressure chamber on the frame.

2. The method of manufacturing an ink-jet head of claim 1, wherein the organic protection film and the hydrophilic film are further located between the insulated substrate and the frame.

3. The method of manufacturing an ink-jet head of claim 1, wherein the organic protection film and the hydrophilic film are further located between the frame and the nozzle plate.

4. The method of manufacturing an ink-jet head of claim 1, wherein the hydrophilic film is a film formed with an atomic layer deposition method.

5. The method of manufacturing an ink-jet head of claim 1, wherein the hydrophilic film is a Ti02 film, an Al203 film, or a Hf02 film.

* * * * *